US010386879B2

(12) United States Patent
Yen et al.

(10) Patent No.: US 10,386,879 B2
(45) Date of Patent: Aug. 20, 2019

(54) BANDGAP REFERENCE VOLTAGE CIRCUIT WITH A STARTUP CURRENT GENERATOR

(71) Applicant: Taiwan Semiconductor Manufacturing Company Limited, Hsinchu (TW)

(72) Inventors: Chen-Lun Yen, Kaohsiung (TW); Cheng-Hsiung Kuo, Hsinchu County (TW)

(73) Assignee: Taiwan Semiconductor Manufacturing Company Limited, Hsinchu (TW)

( * ) Notice: Subject to any disclaimer, the term of this patent is extended or adjusted under 35 U.S.C. 154(b) by 0 days.

(21) Appl. No.: 14/600,406

(22) Filed: Jan. 20, 2015

(65) Prior Publication Data

US 2016/0209860 A1 Jul. 21, 2016

(51) Int. Cl.
*G05F 3/30* (2006.01)
*G05F 3/08* (2006.01)

(52) U.S. Cl.
CPC . *G05F 3/08* (2013.01); *G05F 3/30* (2013.01)

(58) Field of Classification Search
CPC ..... G05F 3/30
See application file for complete search history.

(56) References Cited

U.S. PATENT DOCUMENTS 4,857,823 A * 8/1989 Bitting ..... G05F 3/267 323/314
6,201,375 B1 * 3/2001 Larson ..... G05F 1/573 323/277
7,286,002 B1 * 10/2007 Jackson ..... G05F 3/30 327/539
2003/0151451 A1 * 8/2003 Takemura ..... G05F 3/227 327/543
2007/0182477 A1 * 8/2007 Kim ..... G05F 3/30 327/539

(Continued)

FOREIGN PATENT DOCUMENTS

CN 101211193 A 7/2008

OTHER PUBLICATIONS

Chinese Office Action; Application No. 201510802064.8; dated Jan. 18, 2017.

(Continued)

*Primary Examiner* — Harry R Behm
(74) *Attorney, Agent, or Firm* — Jones Day

(57) ABSTRACT

A bandgap reference voltage circuit includes a bandgap reference voltage generator and a startup current generator. The bandgap reference voltage generator is configured to generate a first voltage and a second voltage. The startup current generator includes a voltage comparator and a switch. The voltage comparator is connected to the bandgap reference voltage generator and is configured to compare the first voltage with the sum of the second voltage and an offset voltage and to generate a comparison result. The switch is connected between the voltage comparator and the bandgap reference voltage generator and is configured to selectively connect a supply voltage to the bandgap reference voltage generator based on the comparison result. A device that includes the circuit is also disclosed. A method of operating the circuit is also disclosed.

15 Claims, 7 Drawing Sheets

(56) References Cited

U.S. PATENT DOCUMENTS

| | | | | |
|---|---|---|---|---|
| 2008/0007244 | A1* | 1/2008 | Draxelmayr | G05F 3/30 323/316 |
| 2008/0157746 | A1* | 7/2008 | Chen | G05F 3/30 323/313 |
| 2008/0224682 | A1* | 9/2008 | Haiplik | G05F 3/30 323/313 |
| 2009/0212753 | A1* | 8/2009 | Lou | G05F 1/563 323/277 |
| 2010/0039091 | A1* | 2/2010 | Vidler | G05F 3/30 323/313 |
| 2011/0248747 | A1* | 10/2011 | Huang | G05F 3/30 327/103 |
| 2014/0232453 | A1* | 8/2014 | Choi | G05F 3/16 327/539 |

OTHER PUBLICATIONS

Korean Office Action; Application No. 10-2015-0151108; dated Apr. 10, 2017.
Chinese Office Action; Application No. 201510802064.8; dated Aug. 16, 2017.
Korean Final Office Action; Application No. 10-2015-0151108; dated Dec. 27, 2017.
Korean Final Office Action; Application No. 10-2015-0151108; dated Mar. 29, 2018.

* cited by examiner

BANDGAP REFERENCE VOLTAGE CIRCUIT WITH A STARTUP CURRENT GENERATOR

BACKGROUND

When a bandgap reference voltage generator starts up properly, the bandgap reference voltage generator operates stably and generates an output voltage that is substantially constant over a wide temperature range. When the bandgap reference voltage generator does not start up properly, the bandgap reference voltage generator still operates stably but does not generate an output voltage or the output voltage generated thereby is no longer constant but fluctuates with the temperature.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
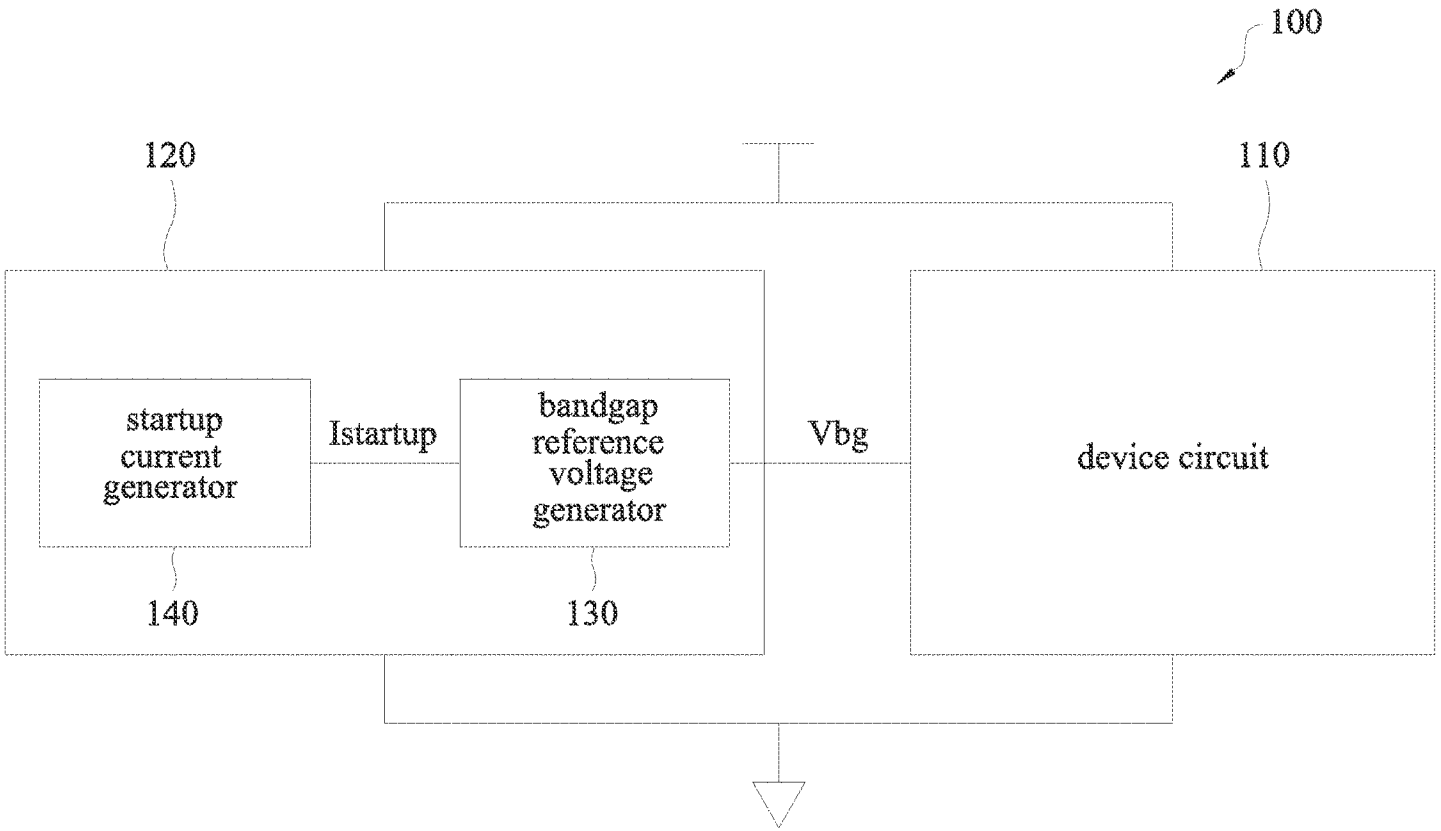
FIG. 1 is a schematic diagram of the first exemplary device in accordance with some embodiments.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

The present disclosure provides a bandgap reference voltage circuit that includes a bandgap reference voltage generator and a startup current generator. The startup current generator facilitates transition of the bandgap reference voltage generator from a state, in which the bandgap reference voltage generator generates a 0 Volt output voltage or a fluctuating output voltage, to another state, in which the bandgap reference voltage generator generates a constant output voltage, as will be hereinafter disclosed.

FIG. 1 is a schematic diagram of the first exemplary device 100 in accordance with some embodiments. As illustrated in FIG. 1, the device 100 includes a device circuit 110 and a bandgap reference voltage circuit 120. In an exemplary embodiment, the device circuit 110 is a voltage regulator, a programmable memory such as a programmable read-only memory (PROM) or an erasable PROM, an analog-to-digital converter, a digital-to-analog converter, another circuit that requires a bandgap reference voltage, or a combination thereof. The bandgap reference voltage circuit 120 includes a bandgap reference voltage generator 130 and a startup current generator 140. The bandgap reference voltage generator 130 is configured to generate an output voltage Vbg that is provided to the device circuit 110, in a manner that will be described below.

Figure 2:
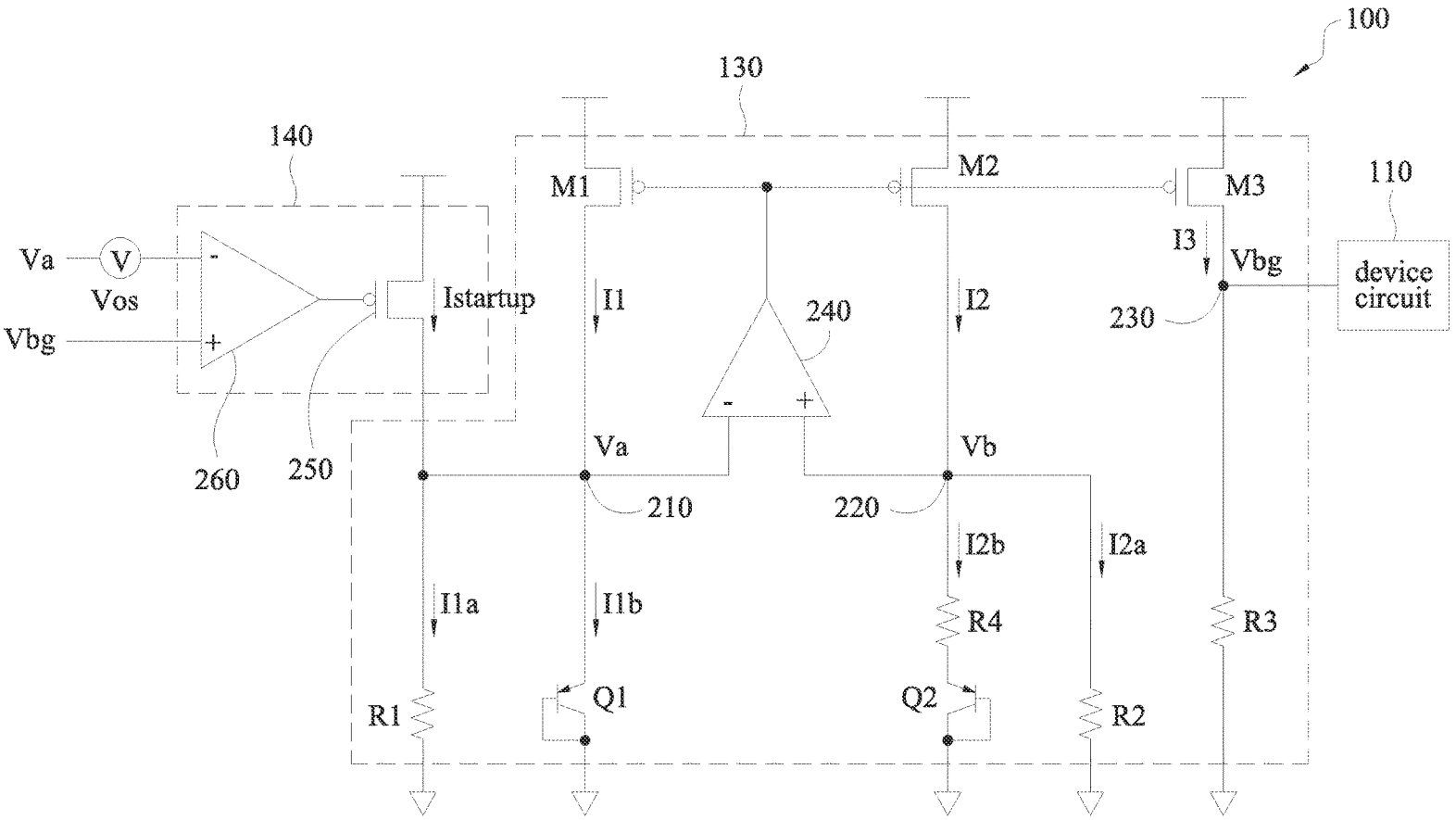
FIG. 2 is a schematic diagram illustrating a bandgap reference voltage generator and a startup current generator in accordance with some embodiments.

FIG. 2 is a schematic diagram illustrating the bandgap reference voltage generator 130 and the startup current generator 140 of the device 100 in accordance with some embodiments. As illustrated in FIG. 2, the bandgap reference voltage generator 130 includes a pair of input nodes 210, 220, an output node 230, five transistors M1, M2, M3, Q1, Q2, four resistors R1, R2, R3, R4, and an operational amplifier 240.

Each of the transistors M1, M2, M3 is p-type metal-oxide-semiconductor (PMOS) transistor, and has a source terminal connected to a supply voltage, a drain terminal connected to a respective one of the input nodes 210, 220 and the output node 230, and a gate terminal. The resistor R1 is connected between the input node 210 and the ground. The resistor R2 is substantially equal to the resistor R1 and is connected between the input node 220 and the ground. The transistor Q1 is a diode-connected PNP bipolar junction transistor and is connected between the input node 210 and the ground. The resistor R4 is connected to the input node 220. The transistor Q2 is a diode-connected PNP bipolar transistor and is connected between the resistor R4 and the ground. The operational amplifier 240 has an inverting input terminal connected to the input node 210, a non-inverting input terminal connected to the input node 220, and an output terminal connected to the gate terminals of the transistors M1, M2, M3.

In operation, after starting up, the bandgap reference voltage generator is in an unstable operating state and generates an input voltage Va at the input node 210 and an input voltage Vb at the input node 220. The operational amplifier 240 then forces the input voltages Va, Vb to be substantially equal. Thereafter, the bandgap reference voltage generator 130 operates stably and generates an output voltage Vbg at the output node 230. In a normal stable operating state, the transistors M1, M2, M3, Q1, and Q2 are turned on. Since the output terminal of the operational amplifier 240 is connected to the gate terminals of the transistors M1, M2, M3, currents I1, I2, I3 flowing through the transistors M1, M2, M3, respectively, are substantially equal. Since the resistors R1, R2 are substantially equal, currents I1*a*, I2*a* flowing through the resistors R1, R2, respectively, are also substantially equal, and thus currents I1*b*, I2*b* flowing through the transistor Q1 and the resistor R4, respectively, are substantially equal. Since a voltage across the transistor Q1 has a negative temperature coefficient, i.e., the voltage across the transistor Q1 is inversely proportional to the temperature, and since a voltage across the resistor R4 has a positive temperature coefficient, i.e., the voltage across the resistor R4 is proportional to the temperature, the output voltage Vbg is independent of the temperature. Different output voltages Vbg can be generated by adjusting the resistor R3.

Based on the operation of the bandgap reference voltage generator 130, the bandgap reference voltage generator 130 operates stably when the input voltages Va, Vb are substantially equal. Therefore, in addition to the normal stable operating state described above, in which the input voltages Va, Vb are greater than a cut-in voltage at which the transistors Q1, Q2 turn on, the bandgap reference voltage generator 130 may further stably operate either in a first undesirable stable operating state, in which the input voltages Va, Va are 0 Volt and thus the output voltage Vbg is 0 Volt, and a second undesirable stable operating state, in which the input voltages Va, Vb are greater than 0 Volt but less than the cut-in voltage of the transistors Q1, Q2, i.e., the transistors Q1, Q2 are turned off, and thus the output voltage Vbg is no longer independent of and varies with the temperature.

As illustrated in FIG. 2, the startup current generator 140 includes a switch 250 and a voltage comparator 260. The switch 250 has a first switch terminal connected to the supply voltage, a second switch terminal connected to the input node 210, and a third switch terminal. In this exemplary embodiment, the switch 250 is a PMOS transistor. In an alternative exemplary embodiment, the switch 250 is an n-type MOS (NMOS) transistor, a complementary MOS (CMOS), another transistor, another normally-open switch, or a combination thereof. The voltage comparator 260 has a non-inverting input terminal connected to the output node 230, an inverting input terminal connected to the input node 210, and an output terminal connected to the third switch terminal of the switch 250. In this exemplary embodiment, the voltage comparator 260 is configured to generate an offset voltage Vos at the inverting input terminal thereof.

Figure 3:
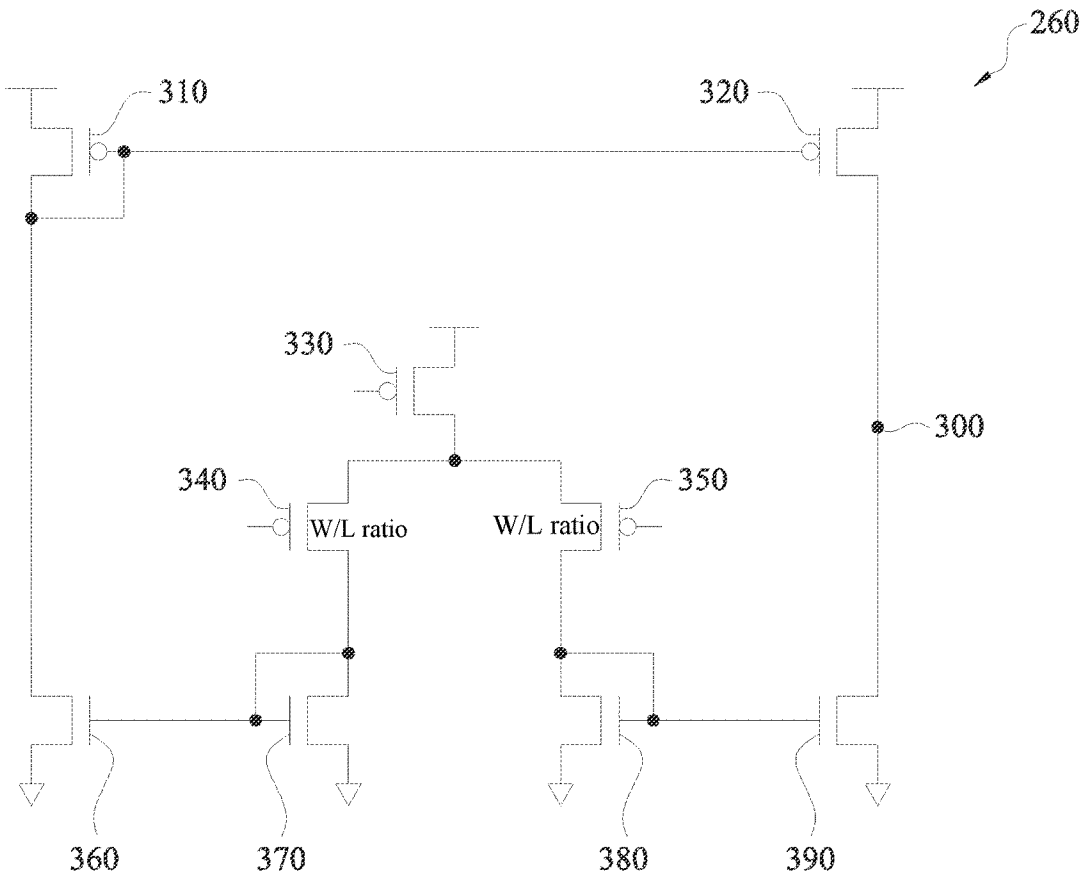
FIG. 3 is a schematic diagram illustrating a voltage comparator of a startup current generator in accordance with some embodiments.

FIG. 3 is a schematic diagram illustrating the voltage comparator 260 of the startup current generator 140 of the device 100 in accordance with some embodiments. As illustrated in FIG. 3, the voltage comparator 260 includes nine transistors, five of which are PMOS transistors 310, 320, 330, 340, 350 and four of which are NMOS transistors 360, 370, 380, 390. The transistor 340 has a gate terminal that serves as the inverting input terminal of the voltage comparator 260. The transistor 350 has a gate terminal that serves as the non-inverting input terminal of the voltage comparator 260. In this exemplary embodiment, the transistor 340 has a W/L ratio, i.e., the ratio of the width to the length of the channel thereof, less than a W/L ratio of the transistor 350, whereby the voltage comparator 260 generates the offset voltage Vos at the inverting input terminal thereof. The transistor 320 has a drain terminal connected to a drain terminal of the transistor 390 at a node 300 that serves as the output terminal of the voltage comparator 260.

An exemplary method for starting up the bandgap reference voltage generator 130 of the device 100 using the startup current generator 140 of the device 100 will be described further below.

Figure 4:
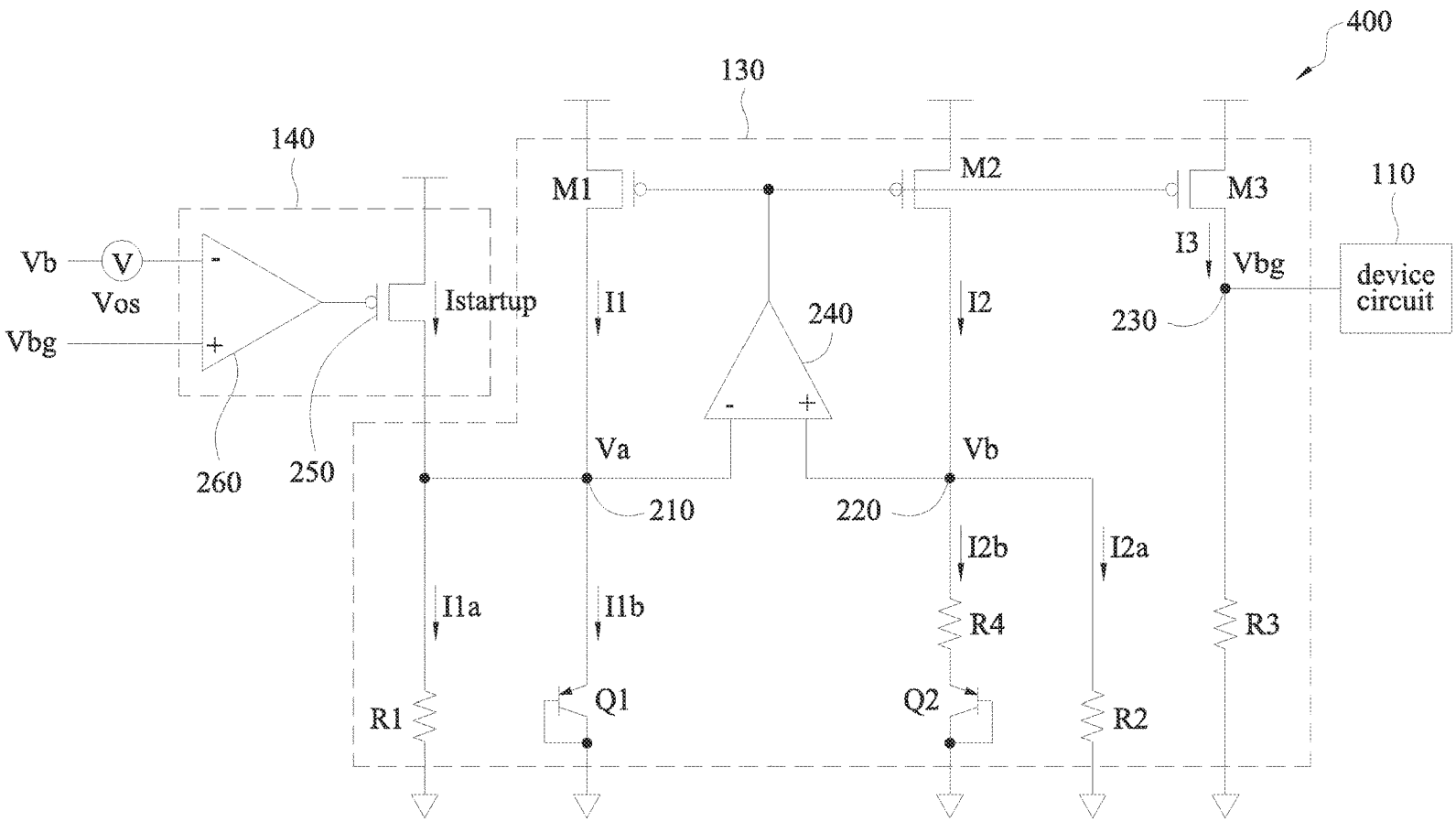
FIG. 4 is a schematic diagram of the second exemplary device in accordance with some embodiments.

FIG. 4 is a schematic diagram of the second exemplary device 400 in accordance with some embodiments. When compared to the device 100, the inverting input terminal of the voltage comparator 260 of the startup current generator 140 of the device 400 is connected to the input node 220.

Since the operation of the bandgap reference voltage generator 130 of the device 400 is similar to that of the bandgap reference voltage generator 130 of the device 100, a detailed description of the same is omitted herein for the sake of brevity.

An exemplary method for starting up the bandgap reference voltage generator 130 of the device 400 using the startup current generator 140 of the device 400 will be described further below.

Figure 5:
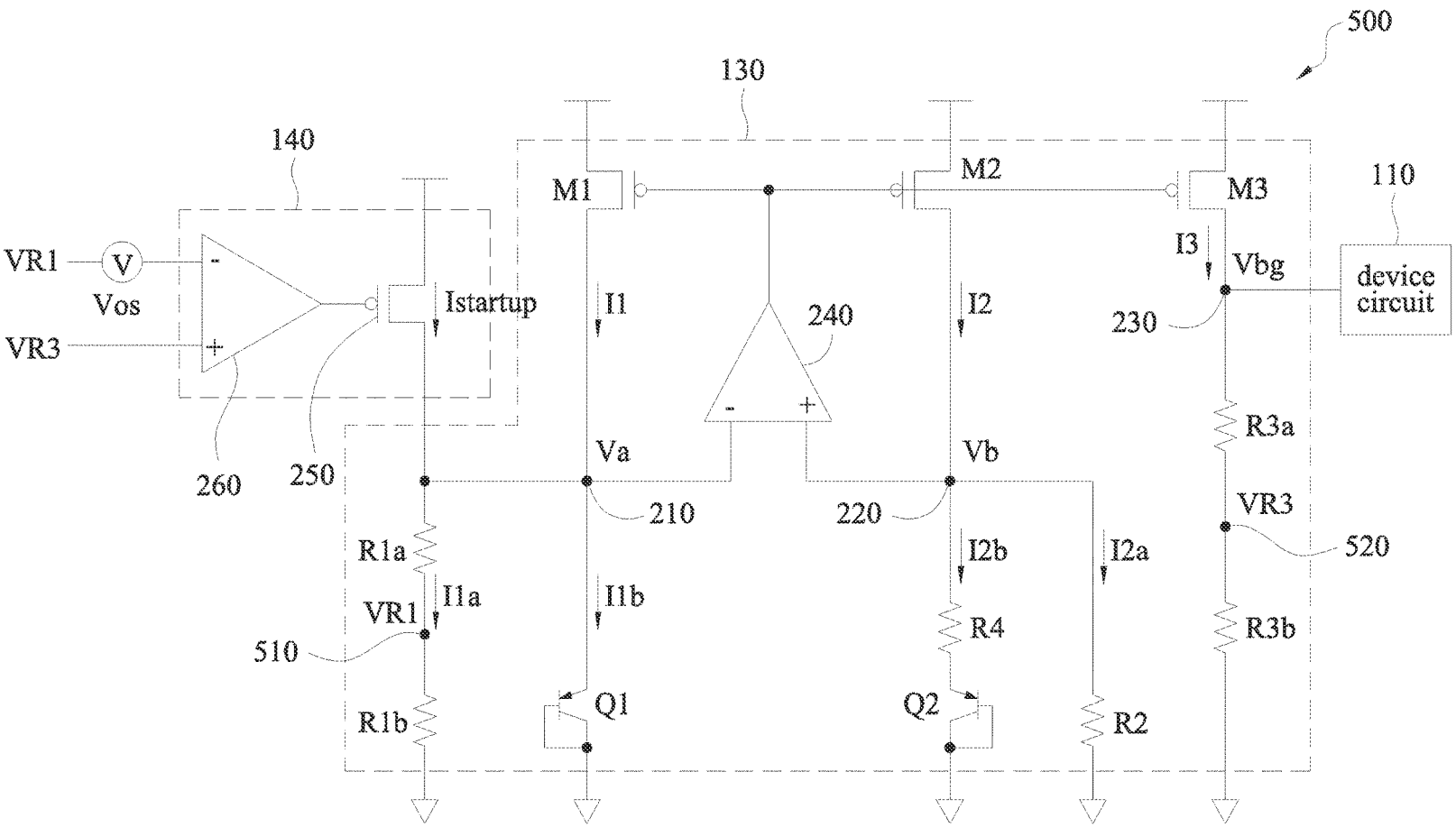
FIG. 5 is a schematic diagram of the third exemplary device in accordance with some embodiments.

FIG. 5 is a schematic diagram of the third exemplary device 500 in accordance with some embodiments. When compared to the device 100, the resistor R1 is replaced with a pair of resistors R1*a*, R1*b* connected in series. The resistor R3 is replaced with a pair of resistors R3*a*, R3*b* connected in series. In addition, the inverting and non-inverting input terminals of the voltage comparator 260 of the startup current generator 140 of the device 500 are respectively connected to a node 510 between the resistors R1*a*, R1*b* and a node 520 between the resistors R3*a*, R3*b*.

Since the operation of the bandgap reference voltage generator 130 of the device 500 is similar to that of the bandgap reference voltage generator 130 of the device 100, a detailed description of the same is omitted herein for the sake of brevity.

An exemplary method for starting the bandgap reference voltage generator 130 of the device 500 using the startup current generator 140 of the device 500 will be described further below.

Figure 6:
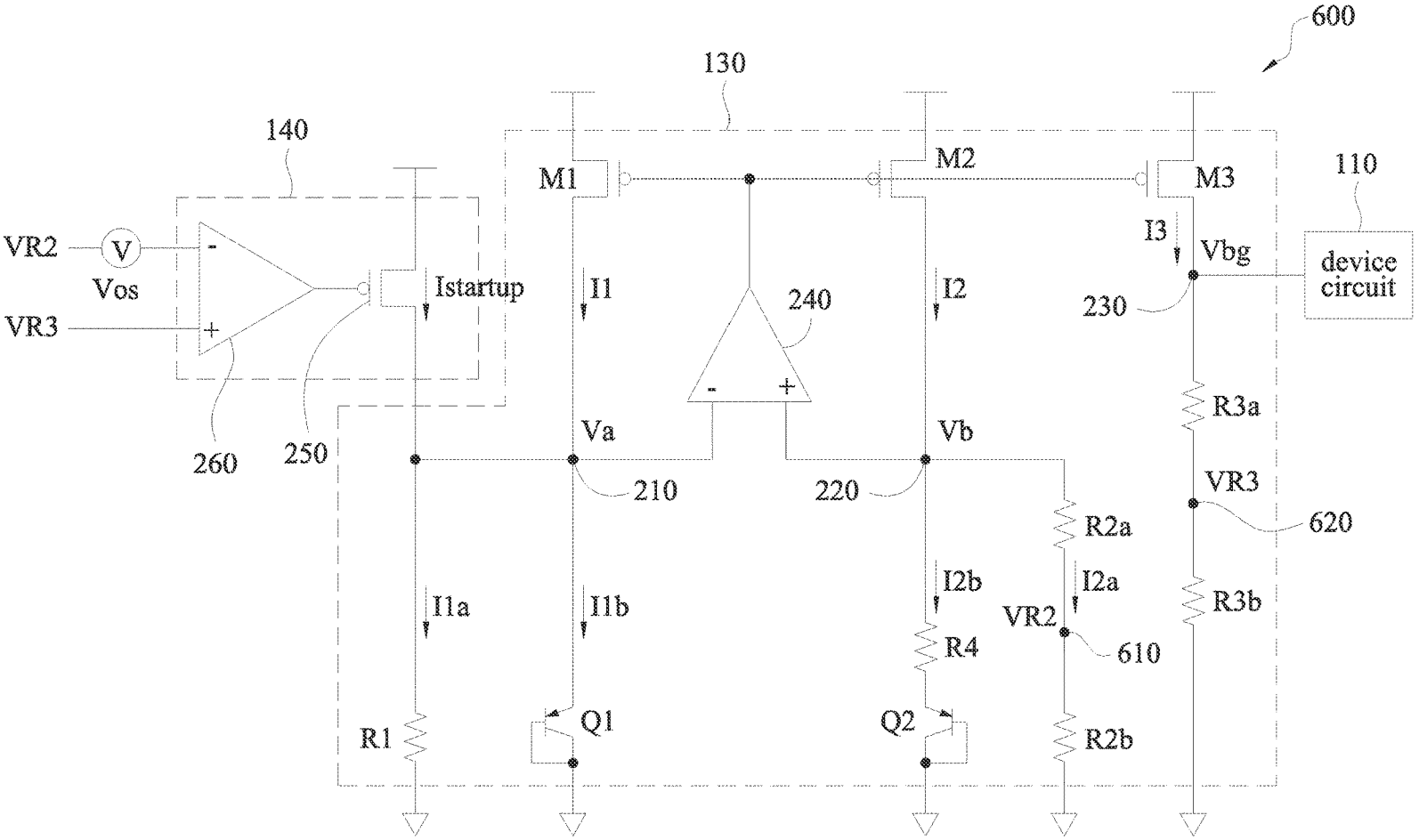
FIG. 6 is a schematic diagram of the fourth exemplary device in accordance with some embodiments.

FIG. 6 is a schematic diagram of the fourth exemplary device 600 in accordance with some embodiments. When compared to the device 100, the resistor R2 is replaced with a pair of resistors R2*a*, R2*b* connected in series. The resistor R3 is replaced with a pair of resistors R3*a*, R3*b* connected in series. In addition, the inverting and non-inverting input terminals of the voltage comparator 260 of the startup current generator 140 of the device 600 are respectively connected to a node 610 between the resistors R2*a*, R2*b* and a node 620 between the resistors R3*a*, R3*b*.

Since the operation of the bandgap reference voltage generator 130 of the device 600 is similar to that of the bandgap reference voltage generator 130 of the device 100, a detailed description of the same is omitted herein for the sake of brevity.

An exemplary method for starting up the bandgap reference voltage generator 130 of the device 600 using the startup current generator 140 of the device 600 will be described further below.

Figure 7:
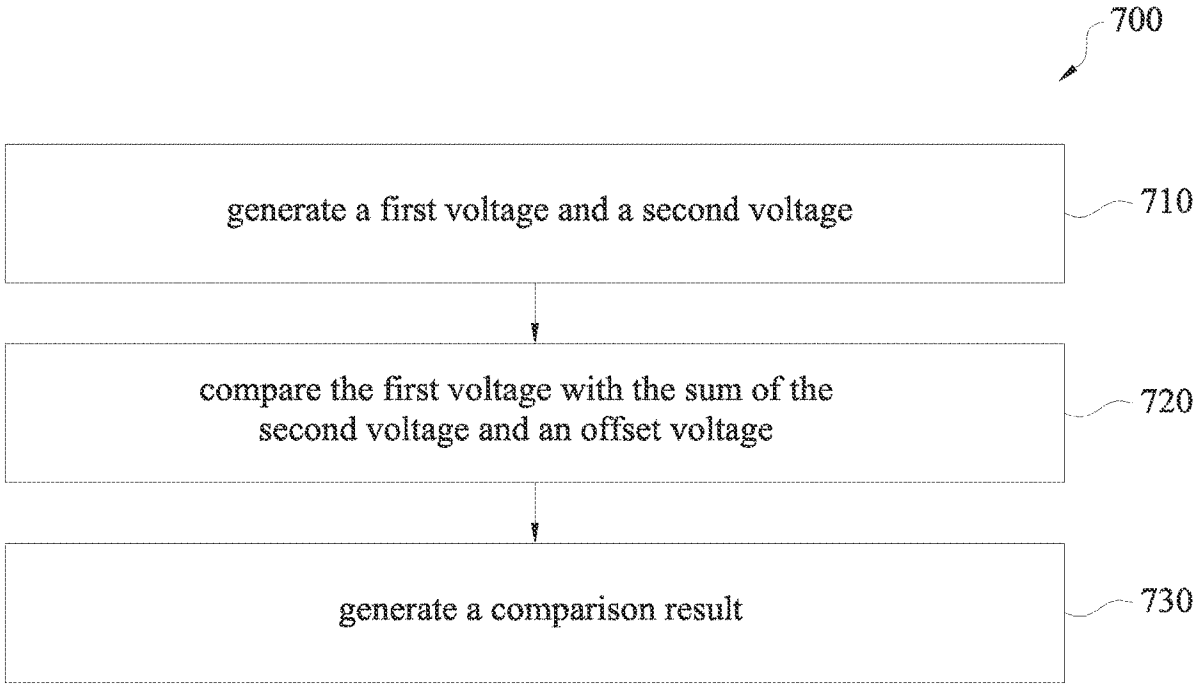
FIG. 7 is a flowchart of an exemplary method for starting up a bandgap reference voltage generator using a startup current generator in accordance with some embodiments.

FIG. 7 is a flowchart of an exemplary method for starting up a bandgap reference voltage generator using a startup current generator in accordance with some embodiments. As illustrated in FIG. 7, in block 710, the bandgap reference voltage generator generates a first voltage and a second voltage. In block 720, a voltage comparator of the startup current generator compares the first voltage with the sum of the second voltage and an offset voltage. In block 730, the voltage comparator generates a comparison result. The use of the comparison result is described in further detail below in the context of the device 100 of FIG. 2.

An exemplary method for starting up the bandgap reference voltage generator 130 of the device 100 of FIG. 2 using the startup current generator 140 of the device 100 of FIG. 2 will now be described according to the method 700 of FIG. 7.

After an initial start up, the bandgap reference voltage generator 130 is in an unstable operating state and generates an input voltage Va at the input node 210 and an input voltage Vb at the input node 220. The operational amplifier 240 then forces the input voltages Va, Vb to be substantially equal. Thereafter, the bandgap reference voltage generator 130 operates stably in one of the first and second undesirable stable operating states and the normal stable operating state and generates an output voltage Vbg at the output node 230.

At this time, the voltage comparator 260 generates an offset voltage Vos at the inverting input terminal thereof and compares the output voltage Vbg with the sum of the input voltage Va and the offset voltage Vos.

When the output voltage Vbg is greater than the sum of the input voltage Va and the offset voltage Vos, i.e., the bandgap reference voltage generator 130 is in the normal stable operating state, the voltage comparator 260 generates a high voltage level at the output terminal thereof. This causes the switch 250 to disconnect the supply voltage from the input node 210.

When the output voltage Vbg is less than the sum of the input voltage Va and the offset voltage Vos, i.e., the bandgap reference voltage generator 130 is either in the first or second undesirable stable operating state, the voltage comparator 260 generates a low voltage level at the output terminal thereof. This causes the switch 250 to connect the supply voltage to the input node 210, whereby a startup current Istartup is generated that flows through the switch 250 and to the input node 210. This, in turn, causes the input voltage Va to increase, thereby causing the bandgap reference voltage generator 130 to restartup, i.e., to transition from the undesirable stable operating state back to the unstable operating state. When the input voltage Va increases to greater than the input voltage Vb, the operational amplifier 240 outputs a low voltage level at the output terminal thereof. This causes currents I1, I2, I3 to flow to the input nodes 210, 220 and output node 230 through the transistors M1, M2, and M3, respectively. This, in turn, causes the input voltage Va to further increase. When the input voltage Va increases to a cut-in voltage of the transistor Q1, the transistor Q1 turns on and a current I1*b* flows through the transistor Q1. At this time, the voltage Vb increases to a cut-in voltage of the transistor Q2, the transistor Q2 turns on, and a current I2*b* flows through the resistor R4. The operational amplifier 240 then again forces the input voltages Va, Vb to be substantially equal. Thereafter, the bandgap reference voltage generator 130 transitions from the unstable operating state to the normal stable operating state. At this time, the output voltage Vbg increases to greater than the sum of the input voltage Va and the offset voltage Vos. This causes the voltage comparator 260 to generate a high voltage level at the output terminal thereof. This, in turn, causes the switch 250 to disconnect the supply voltage from the input node 210, thereby stopping the generation of the startup current Istartup.

An exemplary method for starting up the bandgap reference voltage generator 130 of the device 400 of FIG. 4 using the startup current generator 140 of the device 400 of FIG. 4 will now be described according to the method 700 of FIG. 7.

After an initial start up, the bandgap reference voltage generator 130 is in an unstable operating state and generates an input voltage Va at the input node 210 and an input voltage Vb at the input node 220. The operational amplifier 240 then forces the input voltages Va, Vb to be substantially equal. Thereafter, the bandgap reference voltage generator 130 operates stably in one of the first and second undesirable stable operating states and the normal stable operating state and generates an output voltage Vbg at the output node 230. At this time, the voltage comparator 260 generates an offset voltage Vos at the inverting input terminal thereof and compares the output voltage Vbg with the sum of the input voltage Vb and the offset voltage Vos.

When the voltage Vbg is greater than the sum of the input voltage Vb and the offset voltage Vos, i.e., the bandgap reference voltage generator 130 is in the normal stable operating state, the voltage comparator 260 generates a high voltage level at the output terminal thereof. This causes the switch 250 to disconnect the supply voltage from the input node 210.

When the output voltage Vbg is less than the sum of the input voltage Vb and the offset voltage Vos, i.e., the bandgap reference voltage generator 130 is either in the first or second undesirable stable operating state, the voltage comparator 260 generates a low voltage level at the output terminal thereof. This causes the switch 250 to connect the supply voltage to the input node 210, whereby a startup current Istartup is generated that flows through the switch 250 and to the input node 210. This, in turn, causes the input voltage Va to increase, thereby causing the bandgap reference voltage generator 130 to transition from the undesirable stable operating state back to the unstable operating state. When the input voltage Va increases to greater than the input voltage Vb, the operational amplifier 240 outputs a low voltage level at the output terminal thereof. This causes currents I1, I2, I3 to flow to the input nodes 210, 220 and output node 230 through the transistors M1, M2, and M3, respectively. This, in turn, causes the input voltage Va to further increase. When the input voltage Va increases to a cut-in voltage of the transistor Q1, the transistor Q1 turns on and a current I1*b* flows through the transistor Q1. At this time, the input voltage Vb increases to a cut-in voltage of the transistor Q2, the transistor Q2 turns on, and a current I2*b* flows through the resistor R4. The operational amplifier 240 then again forces the input voltages Va, Vb to be substantially equal. Thereafter, the bandgap reference voltage generator 130 transitions from the unstable operating state to the normal stable operating state. At this time, the output voltage Vbg increases to greater than the sum of the input voltage Vb and the offset voltage Vos. This causes the voltage comparator 260 to generate a high voltage level at the output terminal thereof. This, in turn, causes the switch 250 to disconnect the supply voltage from the input node 210, thereby stopping the generation of the startup current Istartup.

An exemplary method for starting up the bandgap reference voltage generator 130 of the device 500 of FIG. 5 using the startup current generator 140 of the device 500 of FIG. 5 will now be described according to the method 700 of FIG. 7.

After an initial start up, the bandgap reference voltage generator 130 is in an unstable operating state and generates an input voltage Va at the input node 210, an input voltage Vb at the input node 220, and a voltage VR1 at the node 510. The operational amplifier 240 then forces the input voltages Va, Vb to be substantially equal. Thereafter, the bandgap reference voltage generator 130 operates stably in one of the first and second undesirable stable operating states and the normal stable operating state and generates an output voltage Vbg at the output node 230 and a voltage VR3 at the node 520. At this time, the voltage comparator 260 generates an offset voltage Vos at the inverting input terminal thereof and compares the voltage VR3 with the sum of the voltage VR1 and the offset voltage Vos.

When the voltage VR3 is greater than the sum of the voltage VR1 and the offset voltage Vos, i.e., the bandgap reference voltage generator 130 is in the normal stable operating state, the voltage comparator 260 generates a high voltage level at the output terminal thereof. This causes the switch 250 to disconnect the supply voltage from the input node 210.

When the voltage VR3 is less than the sum of the voltage VR1 and the offset voltage Vos, i.e., the bandgap reference voltage generator 130 is either in the first or second undesirable stable operating state, the voltage comparator 260 generates a low voltage level at the output terminal thereof. This causes the switch 250 to connect the supply voltage to the input node 210, whereby a startup current Istartup is generated that flows through the switch 250 and to the input node 210. This, in turn, causes the input voltage Va to increase, thereby causing the bandgap reference voltage generator 130 to transition from the undesirable stable operating state back to the unstable operating state. When the input voltage Va increases to greater than the input voltage Vb, the operational amplifier 240 outputs a low voltage level at the output terminal thereof. This causes currents I1, I2, I3 to flow to the input nodes 210, 220 and output node 230 through the transistors M1, M2, and M3, respectively. This, in turn, causes the input voltage Va to further increase. When the input voltage Va increases to a cut-in voltage of the transistor Q1, the transistor Q1 turns on and a current I1*b* flows through the transistor Q1. At this time, the input voltage Vb increases to a cut-in voltage of the transistor Q2, the transistor Q2 turns on, and a current I2*b* flows through the resistor R4. The operational amplifier 240 then again forces the input voltages Va, Vb to be substantially equal. Thereafter, the bandgap reference voltage generator 130 transitions from the unstable operating state to the normal stable operating state. At this time, the voltage VR3 increases to greater than the sum of the voltage VR1 and the offset voltage Vos. This causes the voltage comparator 260 to generate a high voltage level at the output terminal thereof. This, in turn, causes the switch 250 to disconnect the supply voltage from the input node 210, thereby stopping the generation of the startup current Istartup.

An exemplary method for starting up the bandgap reference voltage generator 130 of the device 600 of FIG. 6 using the startup current generator 140 of the device 600 of FIG. 6 will now be described according to the method 700 of FIG. 7.

After an initial start up, the bandgap reference voltage generator 130 is in an unstable operating state and generates an input voltage Va at the input node 210, an input voltage Vb at the input node 220, and a voltage VR2 at the node 610. The operational amplifier 240 then forces the input voltages Va, Vb to be substantially equal. Thereafter, the bandgap reference voltage generator 130 operates stably in one of the first and second undesirable stable operating states and the normal stable operating state and generates an output voltage Vbg at the output node 230 and a voltage VR3 at the node 620. At this time, the voltage comparator 260 generates an offset voltage Vos at the inverting input terminal thereof and compares the voltage VR3 with the sum of the voltage VR2 and the offset voltage Vos.

When the voltage VR3 is greater than the sum of the voltage VR2 and the offset voltage Vos, i.e., the bandgap reference voltage generator 130 is in the normal stable operating state, the voltage comparator 260 generates a high voltage level at the output terminal thereof. This causes the switch 250 to disconnect the supply voltage from the input node 210.

When the voltage VR3 is less than the sum of the voltage VR2 and the offset voltage Vos, i.e., the bandgap reference voltage generator 130 is either in the first or second undesirable stable operating state, the voltage comparator 260 generates a low voltage level at the output terminal thereof. This causes the switch 250 to connect the supply voltage to the input node 210, whereby a startup current Istartup is generated that flows through the switch 250 and to the input node 210. This, in turn, causes the input voltage Va to increase, thereby causing the bandgap reference voltage generator 130 to transition from the undesirable stable operating state back to the unstable operating state. When the input voltage Va increases to greater than the input voltage Vb, the operational amplifier 240 outputs a low voltage level at the output terminal thereof. This causes currents I1, I2, I3 to flow to the input nodes 210, 220 and output node 230 through the transistors M1, M2, and M3, respectively. This, in turn, causes the input voltage Va to further increase. When the input voltage Va increases to a cut-in voltage of the transistor Q1, the transistor Q1 turns on and a current I1*b* flows through the transistor Q1. At this time, the input voltage Vb increases to a cut-in voltage of the transistor Q2, the transistor Q2 turns on, and a current I2*b* flows through the resistor R4. The operational amplifier 240 then again forces the input voltages Va, Vb to be substantially equal. Thereafter, the bandgap reference voltage generator 130 transitions from the unstable operating state to the normal stable operating state. At this time, the voltage VR3 increases to greater than the sum of the voltage VR2 and the offset voltage Vos. This causes the voltage comparator 260 to generate a high voltage level at the output terminal thereof. This, in turn, causes the switch 250 to disconnect the supply voltage from the input node 210, thereby stopping the generation of the startup current Istartup.

In an exemplary embodiment of a bandgap reference voltage circuit, the bandgap reference voltage circuit comprises a bandgap reference voltage generator and a startup current generator. The bandgap reference voltage generator is configured to generate a first voltage and a second voltage. The startup current generator includes a voltage comparator and a switch. The voltage comparator has an inverting input terminal and a non-inverting input terminal both connected to the bandgap reference voltage generator, and an output terminal, and is configured to compare the first voltage with the sum of the second voltage and an offset voltage and to generate a comparison result. The switch is connected between the output terminal of the voltage comparator and the bandgap reference voltage generator and is configured to selectively connect a supply voltage to the bandgap reference voltage generator based on the comparison result.

In an exemplary embodiment of a device, the device comprises a device circuit, and a bandgap reference voltage circuit that is connected to the device circuit, that is configured to provide an output voltage to the device circuit, and that includes a bandgap reference voltage generator and a startup current generator. The bandgap reference voltage generator is configured to generate a first voltage and a second voltage. The startup current generator includes a voltage comparator and a switch. The voltage comparator has an inverting input terminal and a non-inverting input terminal both connected to the bandgap reference voltage generator, and an output terminal, and is configured to compare the first voltage with the sum of the second voltage and an offset voltage and to generate a comparison result. The switch is connected between the output terminal of the voltage comparator and the bandgap reference voltage generator, and is configured to selectively connect a supply voltage to the bandgap reference voltage generator based on the comparison result.

In an exemplary embodiment of a method of operating a bandgap reference voltage circuit, the method comprises: generating a first voltage and a second voltage using the bandgap reference voltage circuit; comparing the first voltage with the sum of the second voltage and an offset voltage using the bandgap reference voltage circuit; and generating a comparison result using the bandgap reference voltage circuit.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A bandgap reference voltage circuit having protection from a number of predetermined stable operating states, the circuit comprising:

a current mode bandgap reference voltage generator circuit with multiple stable states configured to eliminate the number of predetermined stable operating states and prevent the current mode bandgap reference voltage circuit from falling into the number of predetermined stable operating states, wherein the number of predetermined stable operating states cause an output voltage fluctuation with temperature, wherein the circuit further includes:

an operational amplifier having an inverting input terminal and a non-inverting input terminal, a first resistor, and a second resistor connected in series with the non-inverting input terminal of the operational amplifier and the first resistor; and a startup current generator configured to detect current flows through the resistors, including:

a voltage comparator wherein the voltage comparator has an output terminal and an inverting input terminal that is connected between the first and second resistors; and a switch connected between the inverting input terminal of the operational amplifier and the output terminal of the voltage comparator, wherein the switch includes a transistor having a gate terminal connected to the output terminal of the voltage comparator and a source/drain terminal connected directly to the inverting input terminal of the operational amplifier, wherein the transistor is configured to break the number of predetermined stable states by injecting current to the inverting input terminal of the operational amplifier, further wherein the bandgap reference voltage generator includes an output node coupled to a first output path resistor in series with a second output path resistor, the non-inverting input terminal of the voltage comparator being connected between the first output path resistor and the second output path resistor.

2. The circuit of claim 1, wherein:

the voltage comparator includes a first transistor having a transistor terminal that serves as the non-inverting input terminal of the voltage comparator and a second transistor having a transistor terminal that serves as the inverting input terminal of the voltage comparator; and the second transistor has a width to length ("W/L") ratio less than a W/L ratio of the first transistor.

3. The circuit of claim 1, wherein the bandgap reference voltage generator includes an output node, a pair of resistors connected in series with the output node, and a node between the resistors at which the non-inverting input terminal of the voltage comparator is connected.

4. The circuit of claim 1, wherein:

the operational amplifier further has an output terminal; and the bandgap reference voltage generator further includes a first transistor having a gate terminal connected to the output terminal of the operational amplifier, and a source/drain terminal, a diode-connected transistor connected to the source/drain terminal of the first transistor, wherein the inverting input terminal of the operational amplifier is connected between the source/drain terminal of the first transistor and the diode-connected transistor, a second transistor having a gate terminal connected to the output terminal of the operational amplifier, and a source/drain terminal, a third resistor, and a fourth resistor connected between the source/drain terminal of the second transistor and the third resistor, wherein the voltage comparator further has a non-inverting input terminal connected between the third and fourth resistors.

5. The circuit of claim 4, wherein the bandgap reference voltage generator further includes a fifth resistor connected in parallel to the diode-connected transistor.

6. The circuit of claim 1, wherein:

the operational amplifier further has an output terminal; and the bandgap reference voltage generator further includes a first transistor having a gate terminal connected to the output terminal of the operational amplifier, and a source/drain terminal, a diode-connected transistor, a third resistor connected between the source/drain terminal of the first transistor and the diode-connected transistor, wherein the non-inverting input terminal of the operational amplifier is connected between the source/drain terminal of the first transistor and the third resistor, and a second transistor having a gate terminal connected to the output terminal of the operational amplifier, and a source/drain terminal, wherein the second output path resistor is connected between the source/drain terminal of the second transistor and the first output path resistor, wherein the voltage comparator further has a non-inverting input terminal connected between the first and second output path resistors.

7. A device having protection from a number of predetermined stable operating states, the device comprising:

a device circuit; and a current mode bandgap reference voltage circuit having protection from the number of predetermined stable operating states, wherein the current mode bandgap reference voltage circuit is connected to the device circuit and further includes:

a current mode bandgap reference voltage generator circuit with multiple stable states configured to eliminate the number of predetermined stable operating states and prevent the current mode bandgap reference voltage circuit from falling into the number of predetermined stable operating states, wherein the number of predetermined stable operating states cause an output voltage fluctuation with temperature, wherein the circuit further includes:

an operational amplifier having an inverting input terminal and a non-inverting input terminal, a first resistor connected to the non-inverting input terminal of the operational amplifier, and a second resistor connected in parallel with the first resistor and in series with a first diode connected transistor and the non-inverting input terminal of the operational amplifier; and a startup current generator states configured to detect current flows through the resistors, including:

a voltage comparator wherein the voltage comparator has an inverting input terminal connected between the non-inverting input terminal of the operational amplifier and the second resistor, a non-inverting input terminal coupled to a reference voltage output node, and an output terminal; and a switch connected directly between the output terminal of the voltage comparator and the inverting input terminal of the operational amplifier, wherein the bandgap reference voltage generator includes an output node for providing the bandgap reference voltage at which the non-inverting input terminal of the voltage comparator is connected.

8. The device of claim 7, wherein:

the voltage comparator includes a first transistor having a transistor terminal that serves as the non-inverting input terminal of the voltage comparator and a second transistor having a transistor terminal that serves as the inverting input terminal of the voltage comparator; and the second transistor has a width to length ("W/L") ratio less than a W/L ratio of the first transistor.

9. The circuit of claim 7, wherein the switch includes a transistor having a gate terminal connected to the output terminal of the voltage comparator and a source/drain terminal connected to the inverting input terminal of the operational amplifier.

10. A bandgap reference voltage circuit having protection from a number of predetermined stable operating states, the circuit comprising:

a current mode bandgap reference voltage generator circuit with multiple stable states configured to eliminate the number of predetermined stable operating states and prevent the current mode bandgap reference voltage circuit from falling into the number of predetermined stable operating states, wherein the number of predetermined stable operating states cause an output voltage fluctuation with temperature, wherein the circuit further includes:

an operational amplifier having an inverting input terminal, a first resistor, and a second resistor connected between the inverting input terminal of the operational amplifier and the first resistor; and a startup current generator configured to detect current flows through the resistors, including:

a voltage comparator wherein the voltage comparator has an output terminal and inverting input terminal that is connected between the first and second resistors, the inverting terminal also coupled between a first output path resistor and a second output path resistor in series with the first output path resistor; and a switch connected directly between the inverting input terminal of the operational amplifier and the output terminal of the voltage comparator.

11. The circuit of claim 10, wherein the switch includes the transistor having a gate terminal connected to the output terminal of the voltage comparator and a source/drain terminal connected to the inverting input terminal of the operational amplifier.

12. The circuit of claim 10, wherein:

the operational amplifier further has an output terminal; and the bandgap reference voltage generator further includes a first transistor having a gate terminal connected to the output terminal of the operational amplifier, and a source/drain terminal, a diode-connected transistor connected to the source/drain terminal of the first transistor, wherein the inverting input terminal of the operational amplifier is connected between the source/drain terminal of the first transistor and the diode-connected transistor, a second transistor having a gate terminal connected to the output terminal of the operational amplifier, and a source/drain terminal, a third resistor, and a fourth resistor connected between the source/drain terminal of the second transistor and the third resistor, wherein the voltage comparator further has a non-inverting input terminal connected between the third and fourth resistors.

13. The circuit of claim 10, wherein:

the operational amplifier further has a non-inverting input terminal and an output terminal; and the bandgap reference voltage generator further includes a first transistor having a gate terminal connected to the output terminal of the operational amplifier, and a source/drain terminal, a diode-connected transistor, a third resistor connected between the source/drain terminal of the first transistor and the diode-connected transistor, wherein the non-inverting input terminal of the operational amplifier is connected between the source/drain terminal of the first transistor and the third resistor, a second transistor having a gate terminal connected to the output terminal of the operational amplifier, and a source/drain terminal, a fourth resistor, and a fifth resistor connected between the source/drain terminal of the second transistor and the fourth resistor, wherein the voltage comparator further has a non-inverting input terminal connected between the fourth and fifth resistors.

14. The circuit of claim 13, wherein the bandgap reference voltage generator further includes a sixth resistor connected in parallel to the series connection of the diode-connected transistor and the third resistor.

15. The circuit of claim 10, wherein:

the voltage comparator further has a non-inverting input terminal and includes a first transistor having a transistor terminal that serves as the non-inverting input terminal of the voltage comparator and a second transistor having a transistor terminal that serves as the inverting input terminal of the voltage comparator; and the second transistor has a width to length ("W/L") ratio less than a W/L ratio of the first transistor.

* * * * *